US012385669B2

(12) United States Patent
Bullick

(10) Patent No.: US 12,385,669 B2
(45) Date of Patent: Aug. 12, 2025

(54) WATER HEATER FOR HEATING WATER USING VARIOUS POWER SOURCES AND ENHANCING ENERGY SAVINGS

(71) Applicant: Robert L. Bullick, Georgetown, TX (US)

(72) Inventor: Robert L. Bullick, Georgetown, TX (US)

( * ) Notice: Subject to any disclaimer, the term of this patent is extended or adjusted under 35 U.S.C. 154(b) by 0 days.

(21) Appl. No.: 18/886,776

(22) Filed: Sep. 16, 2024

(65) Prior Publication Data

US 2025/0093075 A1 Mar. 20, 2025

Related U.S. Application Data

(60) Provisional application No. 63/538,655, filed on Sep. 15, 2023.

(51) Int. Cl.

| | |
|---|---|
| ***F24H 9/20*** | (2022.01) |
| ***F24H 1/20*** | (2022.01) |
| ***F24H 15/16*** | (2022.01) |
| ***H05B 3/78*** | (2006.01) |

(52) U.S. Cl.
CPC ..... *F24H 15/16* (2022.01); *F24H 1/201* (2013.01)

(58) Field of Classification Search
CPC ..... F24H 1/20; F24H 9/20; F24H 1/10
See application file for complete search history.

(56) References Cited

U.S. PATENT DOCUMENTS

| | | | | |
|---|---|---|---|---|
| 4,246,956 | A | 1/1981 | Drucker | |
| 4,436,983 | A * | 3/1984 | Solobay | F24H 1/225 392/489 |
| 4,692,592 | A * | 9/1987 | Kale | F28D 20/0039 392/450 |

(Continued)

FOREIGN PATENT DOCUMENTS

| | | | |
|---|---|---|---|
| CN | 203163145 | U | 8/2013 |
| CN | 203190623 | U | 9/2013 |

(Continued)

OTHER PUBLICATIONS

Li, Qin-Yi et al.; Performance analysis of a rooftop wind solar hybrid heat pump system for buildings; https://sci-hub.st/10.1016/j.enbuild.2013.05.048; May 27, 2013.

(Continued)

*Primary Examiner* — Ibrahime A Abraham
*Assistant Examiner* — Lawrence H Samuels
(74) *Attorney, Agent, or Firm* — HULSEY P.C.

(57) ABSTRACT

A water heater and a method for heating water using various power sources and enhancing energy savings are disclosed. The water heater includes a first heating element within an inlet pipe. The first heating element draws energy from a first power source to heat water to a first temperature. The water heater further includes a second heating element within an outlet pipe. The second heating element draws power from a second power source to heat water from the first temperature to a second temperature. Optionally, when the second power source is unavailable or insufficient, then the second heating element draws power from a third power source to heat water from the first temperature to the second temperature.

18 Claims, 10 Drawing Sheets

(56) References Cited

U.S. PATENT DOCUMENTS

| | | | | |
|---|---|---|---|---|
| 5,325,822 | A * | 7/1994 | Fernandez | F24H 15/174 219/486 |
| 5,408,578 | A * | 4/1995 | Bolivar | F24H 1/102 219/494 |
| 6,785,466 | B1 * | 8/2004 | Jackson | F24H 1/202 392/450 |
| 7,190,894 | B2 * | 3/2007 | Chamberlain, Jr. | F24H 1/102 392/488 |
| 8,150,246 | B1 * | 4/2012 | Bolivar | F24H 1/102 392/500 |
| 9,557,067 | B2 | 1/2017 | Kojima | |
| 9,885,484 | B2 | 2/2018 | Young et al. | |
| 10,139,135 | B1 * | 11/2018 | Lesage | F24H 9/2007 |
| 10,571,135 | B2 | 2/2020 | Kreutzman | |
| 11,480,366 | B2 | 10/2022 | Or et al. | |
| 2004/0069768 | A1 * | 4/2004 | Patterson | G05B 23/0283 374/E7.042 |
| 2010/0031953 | A1 | 2/2010 | Krassimire et al. | |
| 2012/0060827 | A1 | 3/2012 | Roetker | |
| 2012/0165999 | A1 * | 6/2012 | Cheng | F24H 9/2028 700/286 |
| 2013/0263843 | A1 * | 10/2013 | Kreutzman | F24H 15/37 126/615 |
| 2013/0266295 | A1 * | 10/2013 | Kreutzman | F24D 19/1006 392/308 |
| 2014/0134550 | A1 * | 5/2014 | Huang | F24D 19/10 431/72 |
| 2014/0348493 | A1 * | 11/2014 | Kreutzman | F24H 1/0018 392/441 |
| 2015/0148971 | A1 * | 5/2015 | Acker | F24H 15/31 700/282 |
| 2017/0356660 | A1 * | 12/2017 | Branecky | F24H 9/2014 |
| 2019/0032958 | A1 * | 1/2019 | Ohse | F24H 15/37 |

FOREIGN PATENT DOCUMENTS

| | | | |
|---|---|---|---|
| CN | 203249303 | U | 10/2013 |
| CN | 203671812 | U | 6/2014 |
| CN | 103900249 | A | 7/2014 |
| CN | 203785282 | U | 8/2014 |
| CN | 204043127 | U | 12/2014 |
| CN | 105222404 | A | 1/2016 |
| CN | 109114804 | B | 11/2020 |
| CN | 105164687 | B | 2/2021 |
| CN | 214370668 | U | 10/2021 |
| DE | 102021200036 | A1 | 7/2022 |
| FR | 2934724 | A1 | 2/2010 |
| JP | 2012202665 | A | 10/2012 |
| JP | 2016044849 | A | 4/2016 |
| KR | 100777830 | B1 | 11/2007 |
| KR | 101811426 | B1 | 1/2018 |
| WO | WO2019081501 | A1 | 5/2019 |
| WO | WO2021053357 | A1 | 3/2021 |

OTHER PUBLICATIONS

Sichilalu, Sam M. et al.; Optimal energy control of grid tied PV-diesel-battery hybrid system powering heat pump water heater; *https://sci-hub.st/10.1016/j.solener.2015.02.028*; Feb. 2015.

Jonas, Danny et al.; Simulation and performance analysis of combined parallel solar thermal and ground or air source heat pump systems; *https://sci-hub.st/10.1016/j.solener.2017.04.070*; Apr. 29, 2017.

DEYE; Hybrid ACDC Solar Air Water Heater; https://www.deyeinverter.com/product/solar-air-conditioner/hybrid-acdc-solar-air-water-heater.html.

Chen, Heng et al.; Performance analysis of a solar-aided waste-to-energy system based on steam reheating; https://sci-hub.st/10.1016/j.applthermaleng.2020.116445; Dec. 20, 2020.

* cited by examiner

WATER HEATER FOR HEATING WATER USING VARIOUS POWER SOURCES AND ENHANCING ENERGY SAVINGS

CROSS-REFERENCE TO RELATED APPLICATIONS

The present application claims benefit of provisional Application No. 63/538,655, filed Sep. 15, 2023; all of which is incorporated herein in its entirety and referenced thereto.

BACKGROUND OF THE INVENTION

Field of the Invention

The present disclosure relates to a water heating system, and in particular, relates to a water heater for heating water using different power sources while enhancing energy savings.

Description of the Prior Art

It is known that water heaters are commonly used in household or commercial applications. In typical water heaters, water is introduced into a storage tank via an inlet water pipe at about 50 degrees Fahrenheit (50° F.). The water heater includes an electrical element within the storage tank typically positioned inside the water heater, or beneath the water tank (for gas heaters). The electrical element is used to heat the water within the water tank to a preset temperature. The electrical element is controlled with the help of a thermostat that is capable of monitoring or measuring the temperature within the water tank.

With improvements in the technology, the power required to heat the electrical element is drawn from a variety of sources such as power grid, renewable power source, among others. Several water heaters operating using different power sources have been disclosed in the past. One such water heater is disclosed in a U.S. Pat. No. 11,480,366, entitled "Solar water heating system" ("the '366 Patent"). The '366 Patent discloses systems and methods for a thermosyphonic water heating system for a storage tank. A DC heat pump receives power from a DC power source and heats water via a heat exchanger using a thermosyphonic piping system. A passive back-flushing having a cold-water inlet pipe connected to the hot water return pipe draws cold water into the storage tank through the heat exchanger. A vertical array of temperature sensors distributed throughout the storage tank monitor temperature of stored water at multiple heights and a communication unit communicates monitored data to an external control device.

Another water heater is disclosed in a United States Publication No. 20130266295, entitled "Hybrid Gas-Electric Hot Water Heater" ("the '295 Publication"). The '295 Publication discloses systems and methods (i.e., utilities) broadly directed to the generation of hot water using energy derived from renewable energy sources. In the various aspects, these utilities are directed to the retrofitting of existing water heaters with electrical heating elements that are connectable to a renewable source of electrical energy. While primarily discussed in relation to retrofitting existing water heaters, various aspects are applicable to OEM manufactured systems. Further, various control methods are provided that allow for enhancing the efficiency of hot water generation, net metering, and/or the generation of renewable energy credits.

Yet another water heater is disclosed in a United States Publication No. 20120060827, entitled "Control for a tankless water heater used with a solar water heating system" ("the '827 Publication"). The '827 Publication discloses a tankless water heating auxiliary system for a solar water heating system, includes a solar collector; a tankless water heater auxiliary system; an insulated water storage tank storing the potable water; a heat exchange system for heating stored water; and piping for connecting the collector, the storage tank and the heat exchanger in fluid communication. A first sensor is connected to and located adjacent to the storage tank for sensing the temperature of the stored water at an outlet of the tank. A method for controlling initiation of heating in a tankless water heater auxiliary system, includes monitoring operation of a tankless water heater; measuring water flow using a water flow sensor to determine if water flow rate exceeds a use determined flow rate; implementing a control time delay into the tankless water heater to purge water from the heater and sense the inlet water supply temperature; measuring the water temperature using a heat exchanger outgoing thermistor; comparing the temperature measured by the thermistor to a predetermined temperature; and initiating a combustion sequence if the temperature measured by the outgoing thermistor is less than the predetermined temperature.

Although the above discussed disclosures are useful, still, there is a need in the art to provide an improved water heater capable of reducing energy cost for major electrical equipment for both end user and suppliers of energy.

SUMMARY OF THE INVENTION

It is an object of the present invention to provide an improved electric water heater and that avoids the drawback of known water heaters.

It is another object of the present invention to provide an improved water heater capable of reducing energy cost for major electrical equipment for both end user and suppliers of energy.

In order to achieve one or more objects, the present invention provides a water heater and a method for heating water using various power sources and enhancing energy savings. The water heater includes a first heating element within an inlet pipe. The first heating element draws energy from a first power source to heat water to a first temperature. The first power source indicates a power supplied by utility service providers, say traditional grid. The water heater further includes a second heating element within an outlet pipe. The second heating element draws power from a second power source to heat water from the first temperature to a second temperature. The second power source indicates energy drawn from renewable energy sources such as solar panels, for example. Optionally, when the second power source is unavailable or insufficient, then the second heating element draws power from a third power source to heat water from the first temperature to the second temperature. The third power source indicates energy drawn from renewable energy sources such as batteries or wind turbines, for example.

In one implementation, the water heater provides a different flow path for hot water located outside of the normal water heater. The flow path may have a first heating element (i.e., cal-rod) at the bottom of the outside flow path connected to an alternative power source or standard utility power. Optionally, the water heater includes a trickle charger controlled by a thermostat that maintains a programmed temperature throughout the hot water heater.

Further, the water heater includes a second heating element (e.g., cal-rod) that runs inside of the inlet pipe hot water heater (HWH). The second heating element is designed to run off any available power source, with alternate power preferred to save energy. The selection of power source is supplied by thermostat program. The transfer of temperature is provided by an outside flow path. The second heating element activates as needed to maintain set water temperature when demand is high.

In addition, the water heater includes a third heating element (e.g., cal-rod) placed in the hot water outlet line which becomes the second cal-rod to activate inside of HWH. The water heater includes a controller integrating a thermostat program that takes sensor data from all sensors, available electrical energy and calculates the amount of energy needed to maintain maximum set HWH temperature.

There are two electric Cal-rods that come with most standard electric water heaters and are primarily supplied electrical energy by a utility company. The electric Cal-rods are controlled by the thermostat program, if the three Cal-rods supplied by the alternate energy cal-rods cannot maintain the max temperature set for HWH. In other words, all Cal-rods, a total of five (5) would be activated and have the same effect as a tank-less water heater system. The same process can be used by a gas HWH. Here, once demand for the hot water is met, the HWH would return to normal operations. The outside flow pipe created by the transfer line may be used to create a heat source for additional heat to the house heating system. This approach can be used anytime. The HWH can be used as a type of boiler. The external pipe can be enlarged to hold additional hot water that would be circulated from the HWH outside to the heat pump where heat is transferred to the heat pump coil and then circulated by small pump back to HWH to be reheated making a complete cycle. The heat exchanger is isolated from the heat pumps fan system to enhance the transfer of heat to the heat pump system.

In one advantageous feature of the present invention, the water heater can be used with existing water tanks for heating water while reducing energy cost at household and commercial structures. The water heater presents a multi-stage heating process that increases the water temperature in a short span of time and improves the overall efficiency of the water heater while minimizing the heat loss.

In another advantageous feature of the present invention, the second heating element allows water inside the outlet pipe to be at operating temperature quickly due to water volume inside hot water heater since the outlet valve is small and easy to bring to operating temperature by the second heating element. Setting a low temperature of 40° or 50° F. for heating by the first heating element helps to save energy cost for both users and power utility providers.

In one alternate implementation, the first heating element is set to heat the water from 100° F. This allows the energy source from the utility company to do the heavy lifting and the second heating element operated using the alternative energy to increase the total tank temperature to a temperature of 125° F. to 140° F. The alternative energy to heat the water tank can be ON to reach set maximum temperature of hot water heater (HWH), once the tank reaches the set temperature, only the alternative energy is needed to maintain temperature at maximum. The natural flow of hotter water to the top of the heater tank is from the cooler bottom of the tank.

In another advantageous feature of the present invention, when there is a power failure, alternate power such as the solar panels get activated and maintain the power for the first heating element.

In yet another advantageous feature of the present invention, the third heating element installed near the bottom of the outside outlet/inlet pipe allows the hot water to flow/migrate upward to aid in maintaining temperature at top of the hot water tank outlets.

In yet another advantageous feature of the present invention, the water heater includes a controller. The controller optimizes the energy usage by controlling the operation of the second heating element based on real-time temperature data. This ensures the energy is consumed only when it is required.

The features and advantages of the invention here will become more apparent in light of the following detailed description of selected embodiments, as illustrated in the accompanying FIGURES. As will be realized, the invention disclosed is capable of modifications in various respects, all without departing from the scope of the invention. Accordingly, the drawings and the description are to be regarded as illustrative in nature.

DETAILED DESCRIPTION OF THE PREFERRED EMBODIMENT

Figure 1:
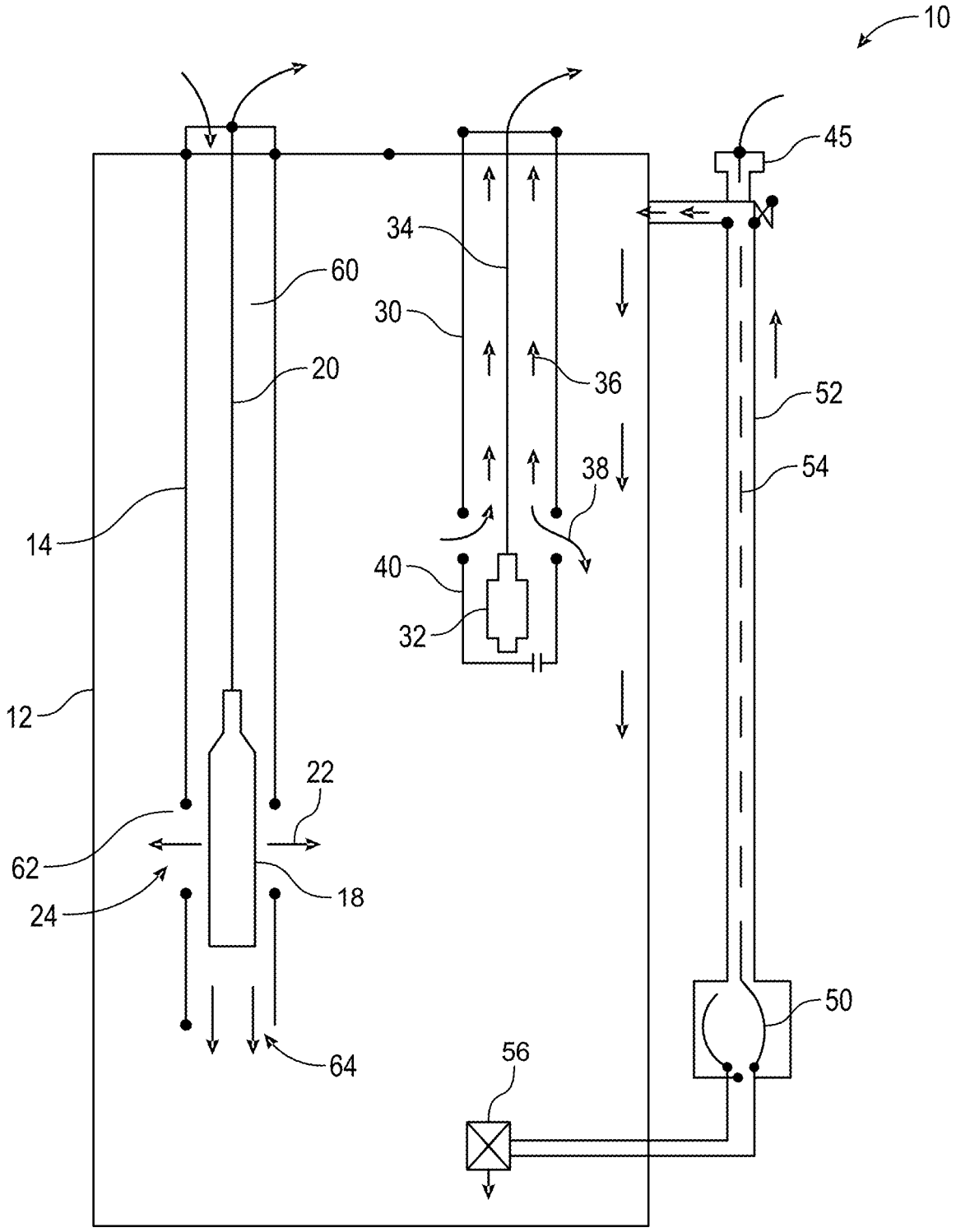
FIG. 1 illustrates a diagrammatic representation of a water heater, in accordance with one embodiment of the present invention.

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed water heater. However, it will be apparent to those skilled in the art that the presently disclosed invention may be practiced without these specific details. In some instances, well-known structures and devices are shown in functional or conceptual diagram form in order to avoid obscuring the concepts of the presently disclosed water heater.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of a water heater, it is to be further understood that numerous changes may arise in the details of the embodiments of the water heater. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

The present invention discloses a water heater and a method for heating water using various power sources and enhancing energy savings. The water heater includes a first heating element within an inlet pipe. The first heating element draws energy from a first power source to heat water to a first temperature. The water heater further includes a second heating element within an outlet pipe. The second heating element draws power from a second power source to heat water from the first temperature to a second temperature. Optionally, when the second power source is unavailable or insufficient, then the second heating element draws power from a third power source to heat water from the first temperature to the second temperature.

In one implementation, the water heater includes rooftop mounted solar panels supplying power to home HVAC units and to an electricity grid. The utility companies can collect the power generation data. The invention further includes a hybrid water heater with a T-shaped connection tube comprising a heating element powered through solar energy providing alternative source for utility power. The invention further includes a hybrid heat pump with a separate chamber for refrigerant heating through heating element using solar energy to bring temperature back to efficient mode for heat pump. The system includes DC batteries to supply electric power in case of unavailability of solar power. The refrigerant of the heat pump is reheated by the heating element using solar power or bypassing through an area heated by microwave or heating element operating through solar power.

Various features and embodiments of a water heater are explained in conjunction with the description of FIGURES (FIGS.) 1-18.

Figure 2:
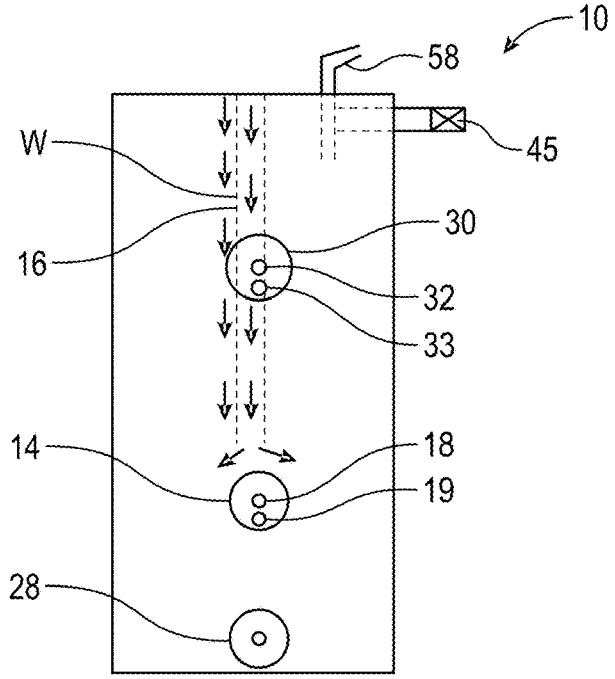
FIG. 2 illustrates a top view of the water heater, in accordance with one embodiment of the present invention.

FIG. 1 shows a diagrammatic representation of a water heater 10, in accordance with one embodiment of the present invention. Further, FIG. 2 shows a top view of water heater 10, in accordance with one embodiment of the present invention. Water heater 10 includes a housing or enclosure or tank 12 made of a suitable material for holding various electrical and mechanical components required for heating water.

Housing 12 includes an inlet pipe 14. Inlet pipe 14 receives water W from a water source. In FIG. 1 and FIG. 2, inlet water flow is denoted with a reference numeral 16 (inlet water flow 16). Inlet pipe 14 connects to a first heating element 18. In one example, first heating element 18 indicates a Calrod™ used as a heating element for converting electricity into heat via Joule heating. In accordance with the present invention, inlet pipe 14 has two connections, a first connection and a second connection that are on top of each other and located outside the top of housing 12. Further, two connections are connected to inlet pipe 14 in a water and pressure tight manner. Here, the first connection is positioned below the first connection. The first connection allows the water to enter inlet pipe 14. Further, the second (top) connection allows a first armored power wire 20 to go through the water connection and attaches to first heating element 18 inside inlet pipe 14.

First heating element 18 has an Alternate Current (AC) supplied by a first power source 19, say via a grid using first power wire 20. Alternatively, first heating element 18 has a Direct current (DC) supplied, if needed. First heating element 18 utilizes first power source 19 to heat water W up to 40 or 50 degrees Fahrenheit (50° F.) or as may be needed. In some embodiments, first power source 19 includes renewable energy, say solar energy used to heat water W up to 40 or 50 degrees Fahrenheit (50° F.) or as may be needed.

Figure 3:
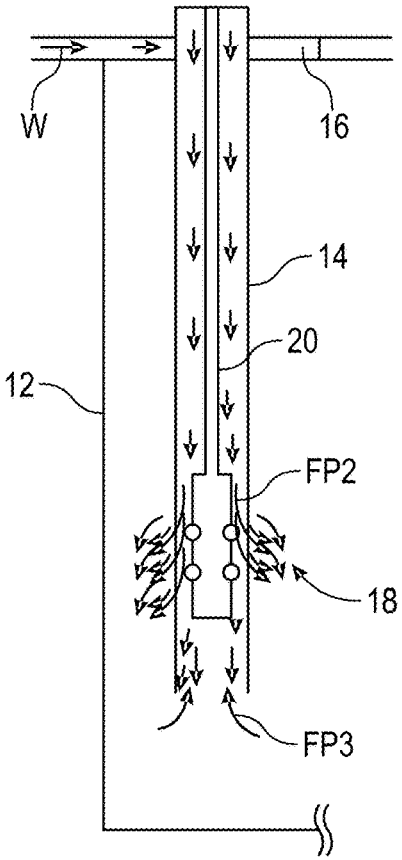
FIG. 3, FIG. 4, FIG. 5A and FIG. 5B illustrate partial views of a first heating element, a second heating element and a third heating element (FIG. 5A and FIG. 5B), of water heater shown in FIG. 1.

Referring to FIG. 1 and FIG. 3, constructional features of first heating element 18 are explained. It should be understood that FIG. 3 shows a partial view of water heater 10 containing first heating element 18 within inlet pipe 14. As can be seen from at least is FIG. 1, first heating element 18 is attached to the bottom of inlet pipe 14 to prevent fluid from moving first heating element 18 up or down inside inlet pipe 14. Optionally, first heating element 18 is not attached to inlet pipe 14 since water flows downward under normal operation and keeps first heating element 18 in place. Further, first heating element 18 creates a flow path 22 using slots or holes 24 for heating water at the middle of first heating element 18. Slots 24 act as open ends for inlet pipe 14 to the whole of water heater 10.

Figure 4:
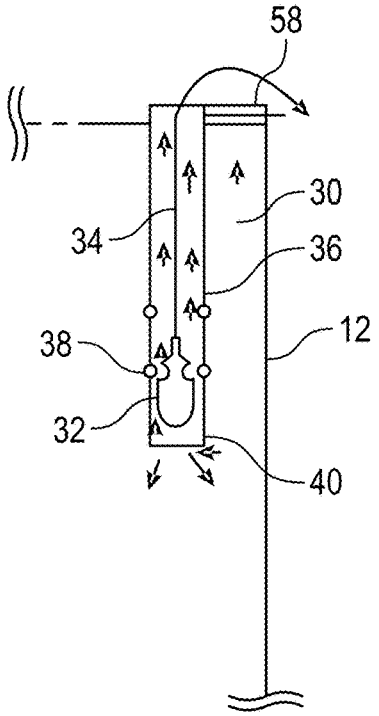

Further, water heater 10 includes an outlet pipe or hot water discharge pipe 30, as shown in FIG. 1 and FIG. 4.

Outlet pipe 30 is configured to discharge the heated water. Outlet pipe 30 includes a second heating element 32. Second heating element 32 indicates a Cal-rod or Calrod™ used as a heating element for converting electricity into heat via Joule heating. FIG. 4 shows a partial view of water heater 10 containing second heating element 32 within outlet pipe 30. As can be seen, outlet pipe 30 has a cap with a second armored power wire 34 that runs through it and is attached to second heating element 32. Similar to first heating element 18, second heating element 32 includes two connections, a first connection and a second connection that are positioned on top of each other and located outside the top of housing 12. Further, two connections are connected to outlet pipe 30 in a water and pressure tight manner. Here, the first connection is positioned below the first connection. The first connection allows the water to enter outlet pipe 30. Further, the second (top) connection allows second power wire 34 to go through the water connection and attaches to second heating element 32 inside outlet pipe 30. Second heating element 32 creates a flow path 36 using slots or holes 38 at the middle of second heating element 32.

Further, outlet pipe 30 encompasses a bottom cap connection 40. Bottom cap connection 40 positions underneath second heating element 32 and keeps second heating element 32 in place when water surges up through outlet pipe 30. Further, bottom cap connection 40 has holes through it to prevent debris from collecting below second heating element 32.

Figure 8:
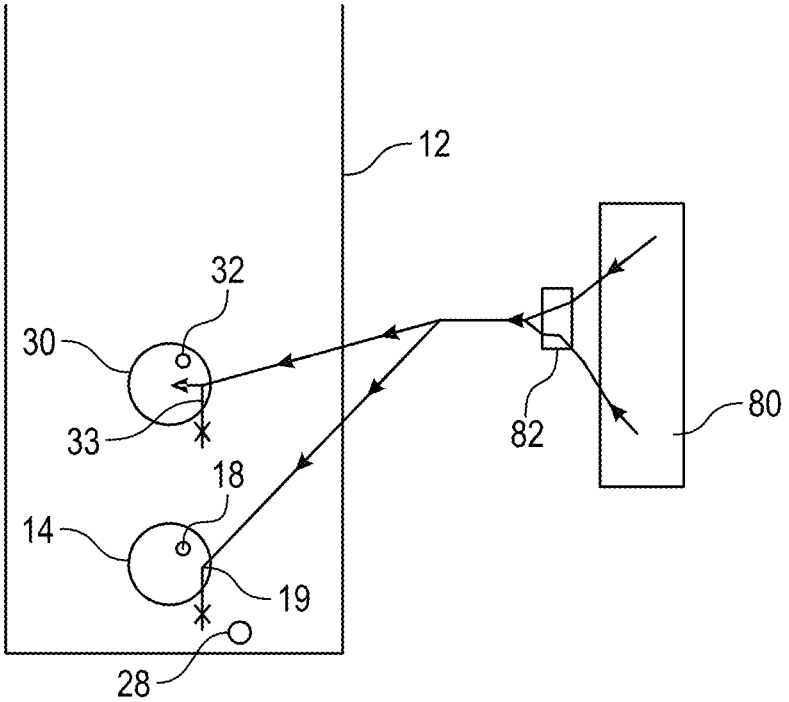
FIG. 8 illustrates the use of batteries as an alternate source of energy for operating a second heating element in the water heater, in accordance with one embodiment of the present invention.

As specified above, second heating element 32 heats water using a second power source 33 such as solar energy. In one example, second power source 33 includes utility company provided AC, Alternating Current or Direct Current from sources other than utility power. In other words, any source of developed AC, DC or batteries work with the presently disclosed water heater. In some embodiments, batteries 80 are used in addition to solar energy. Batteries 80 can be used to supply electrical energy when solar energy is not available or when the solar energy is insufficient to power second heating element 32. FIG. 8 shows use of batteries 80 with each of first heating element 18 and second heating element 32 with the help of a converter 82. As can be seen from FIG. 8, batteries 80 are used when it is determined that solar energy is not active or insufficient to operate second heating element 32. In one example, a wind turbine (not shown) is used with batteries 80 to supplement solar panels and during low sun conditions. Optionally, a gas fired water heater or gas fired burner is used to supplement solar panels for operating second heating element 32. Other natural resources may be used to increase energy savings.

Figure 9A:
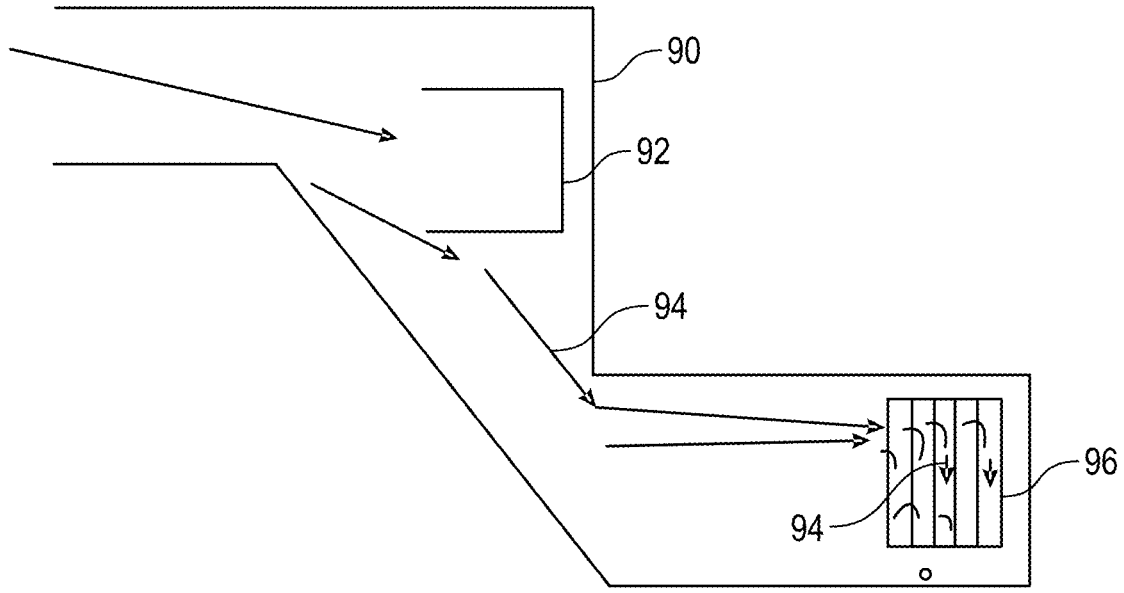
FIG. 9A and FIG. 9B illustrate the water heater as used in the environment of an attic, in accordance with one exemplary embodiment of the present invention.
Figure 9B:
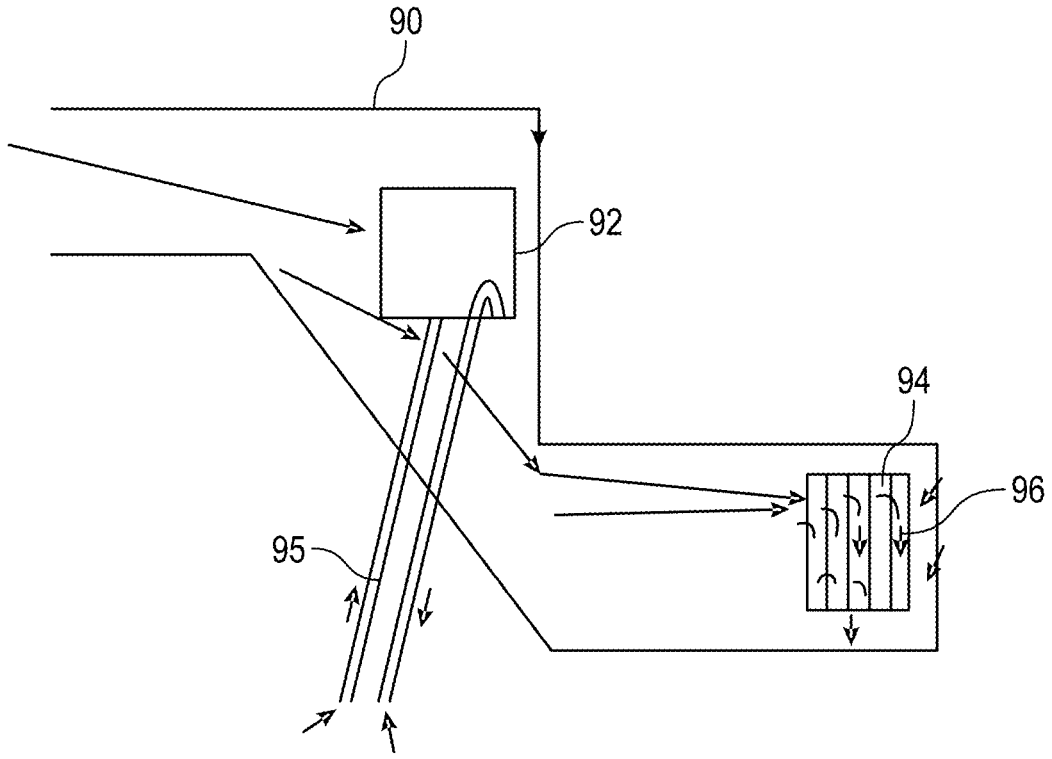
Figure 10:
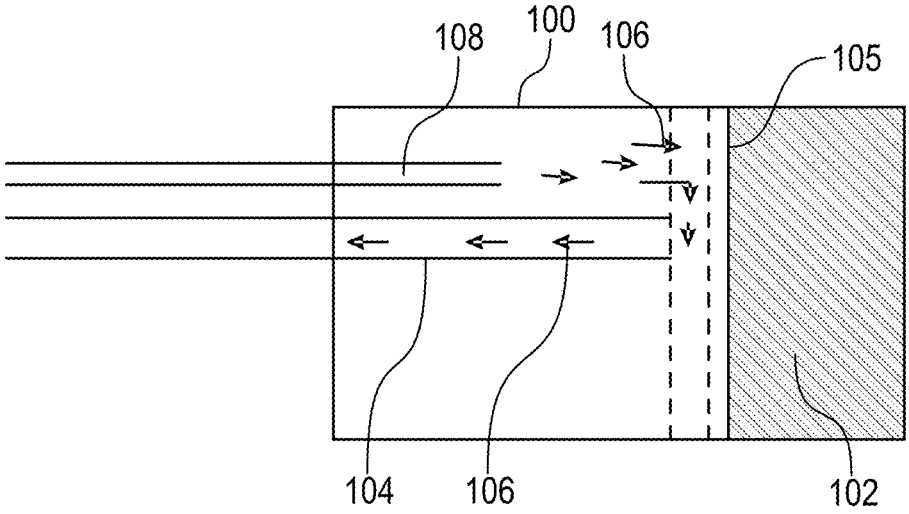
FIG. 10 illustrates a heat pump having one suction line and one discharge line, in accordance with one exemplary embodiment of the present invention.

FIG. 9A shows an exemplary embodiment in which water heater 10 is used at an attic with air 94 from duct wall 90 passing by coils 92 and entering air conditioning duct to ventilator 96 to a living area. The Freon is used similar to an air-conditioner. In one example, hot water is returned to water heater 10 to reuse via water faucet 28. FIG. 9B shows another exemplary embodiment in which water heater 10 is used at an attic with air 94 from duct wall 90 passing by coils 92 with hot water and then back to an air conditioning duct to be circulated to add worth to the living area. The Freon is used similar to an air-conditioner. In one example, hot water is returned to water heater 10 via tubes 95 to reuse via water faucet 28. In one example, the drain line from inside the container for the hot water heater (HWH) is needed in case a water leak is developed. FIG. 9B is presented to have a different flow path for hot water located outside of a normal water heater. This flow path may have a heating element (cal-rod) at the bottom of the outside flow path connected to an alternative power source or standard utility power. FIG. 10 shows a heat pump 100 having a line 104 sucking air 106 and another line 108 discharging the air 106. Here, a heat plate 105 separates an area 102 from F Freon. Area 102 is heated by microwave or other heating sources.

Figure 11:
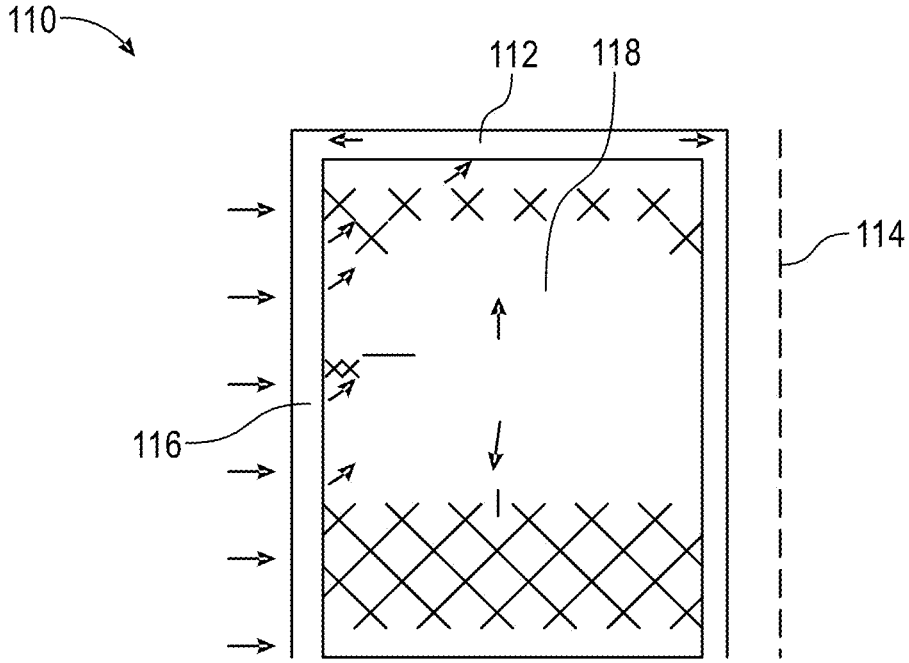
FIG. 11 illustrates a schematic view of a housing for receiving a heat pump air conditioning unit or regular air conditioning unit, in accordance with one exemplary embodiment of the present invention.

FIG. 11 shows a schematic view of a housing 110 for receiving a heat pump air conditioning unit or regular air conditioning unit 118. Here, housing 110 is presented to explain a method involving building two walls of two different materials to supply cooler air to the heat pump unit by reducing the sun's hotter rays and enhancing the efficiency of a heat pump or conventional air conditioning system. The first wall is placed four inches from the sides of the heat pump walls and is totally enclosing the heat pump unit. The first wall is made of 80% shade cloth or 45% aluminum covered shade cloth. The shade cloth has 4 inches laying on and attached to the ground to prevent outside air from entering at the bottom of the shade cloth. There is a frame used to hold shade cloth upright. The top of the shade cloth is folded over the frame and is allowed to cover all but a fan opening on all four sides of the AC unit. This shade cloth allows outside air to be pulled thru the shade cloth and be expelled by the fan. If the aluminum covered shade cloth is used it will reflect the sun's rays and heat away before entering the ac unit. This will result in a cooling effect of the outside air temperature. The heat rays are exhausted upward, and the shade cloth removes about 45% of the sun's heat.

The second wall around the heat pump unit consists of radiant barriers that removes and dissipates the heat waves from getting to the shade cloth and improves the cooling effect further. Each of the radiant barriers is placed standing up and are four inches away from each other and overlap each other by four inches, all the way around the heat pump assembly. This arrangement allows free flow of air to the shade cloth minus the heat reflected away. The height of the radiant barriers can be seen as the shadow on the AC unit. It needs to be high enough to keep all sunlight from hitting on the AC unit at any time of the day on any side.

Figure 12:
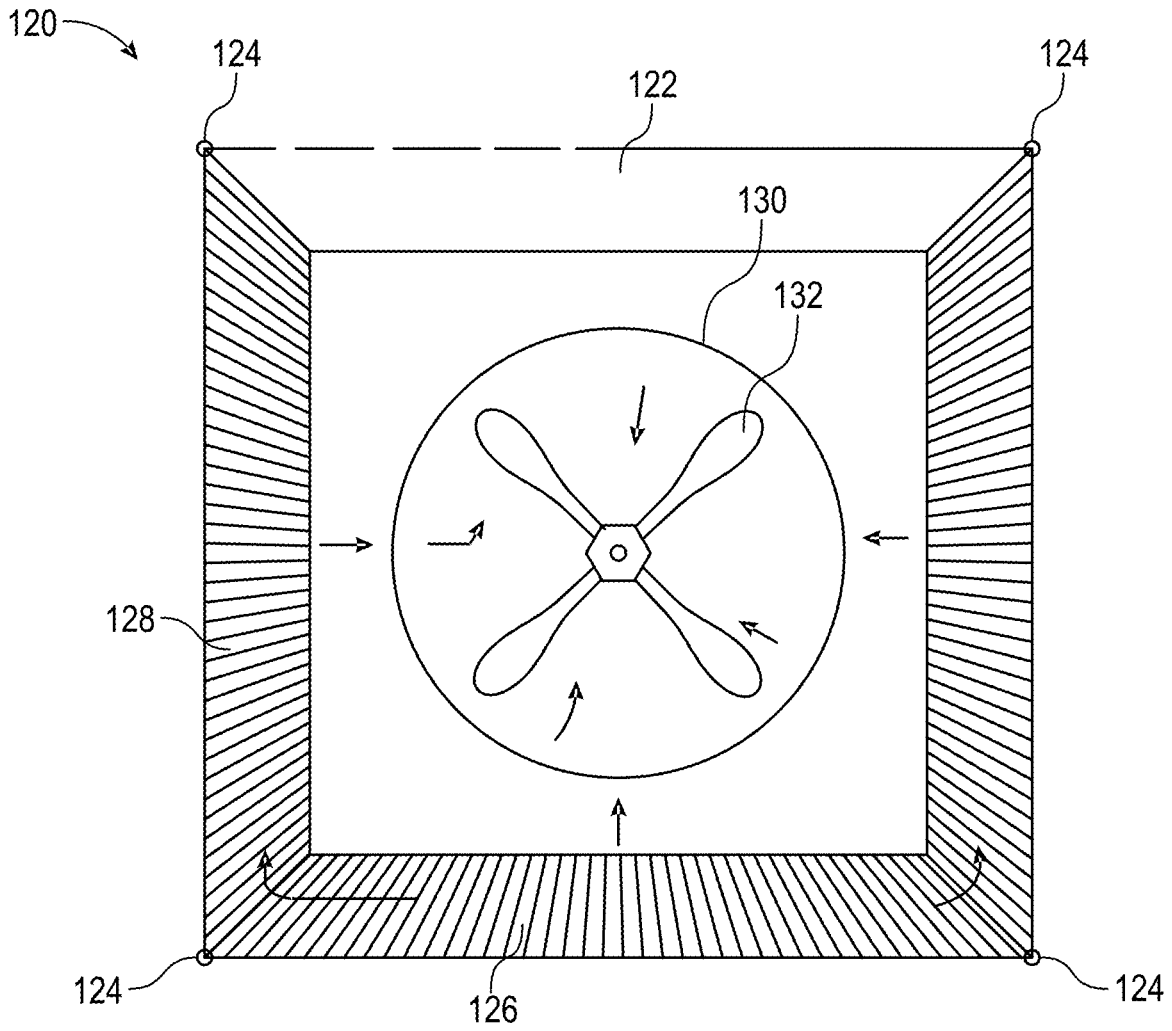
FIG. 12 illustrates a shade cloth provided at sides of the air conditioning unit, in accordance with one exemplary embodiment of the present invention.
Figure 13:
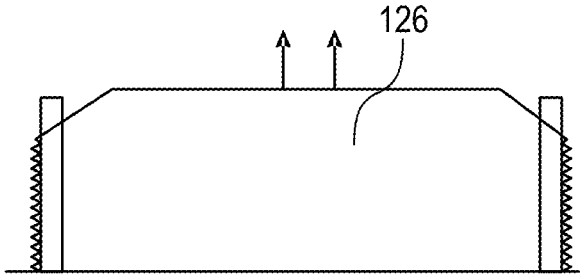
FIG. 13 illustrates a feature of the shade cloth.
Figure 14:
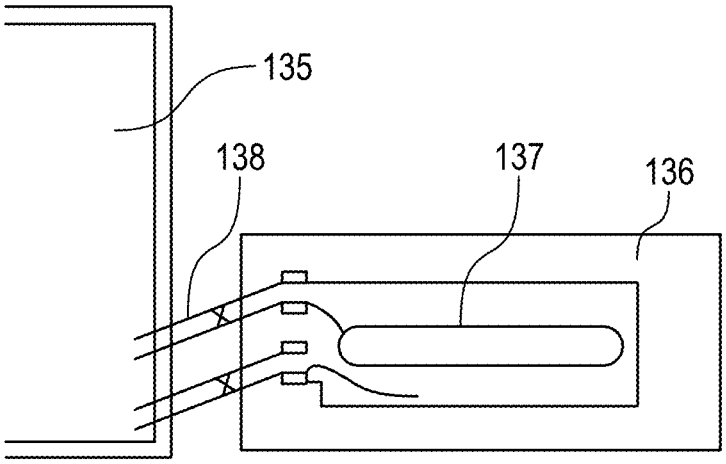
FIG. 14 illustrates a bottom portion of the air conditioning unit 118 shown above in FIG. 11.
Figure 15:
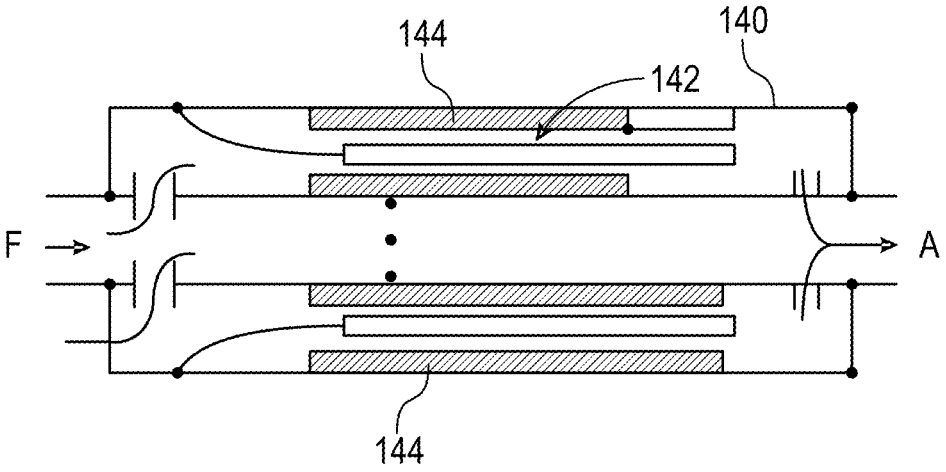
FIG. 15 illustrates a schematic diagram representing heating of freon to add usable heat to attic A coil, in accordance with one exemplary embodiment of the present invention.
Figure 16:
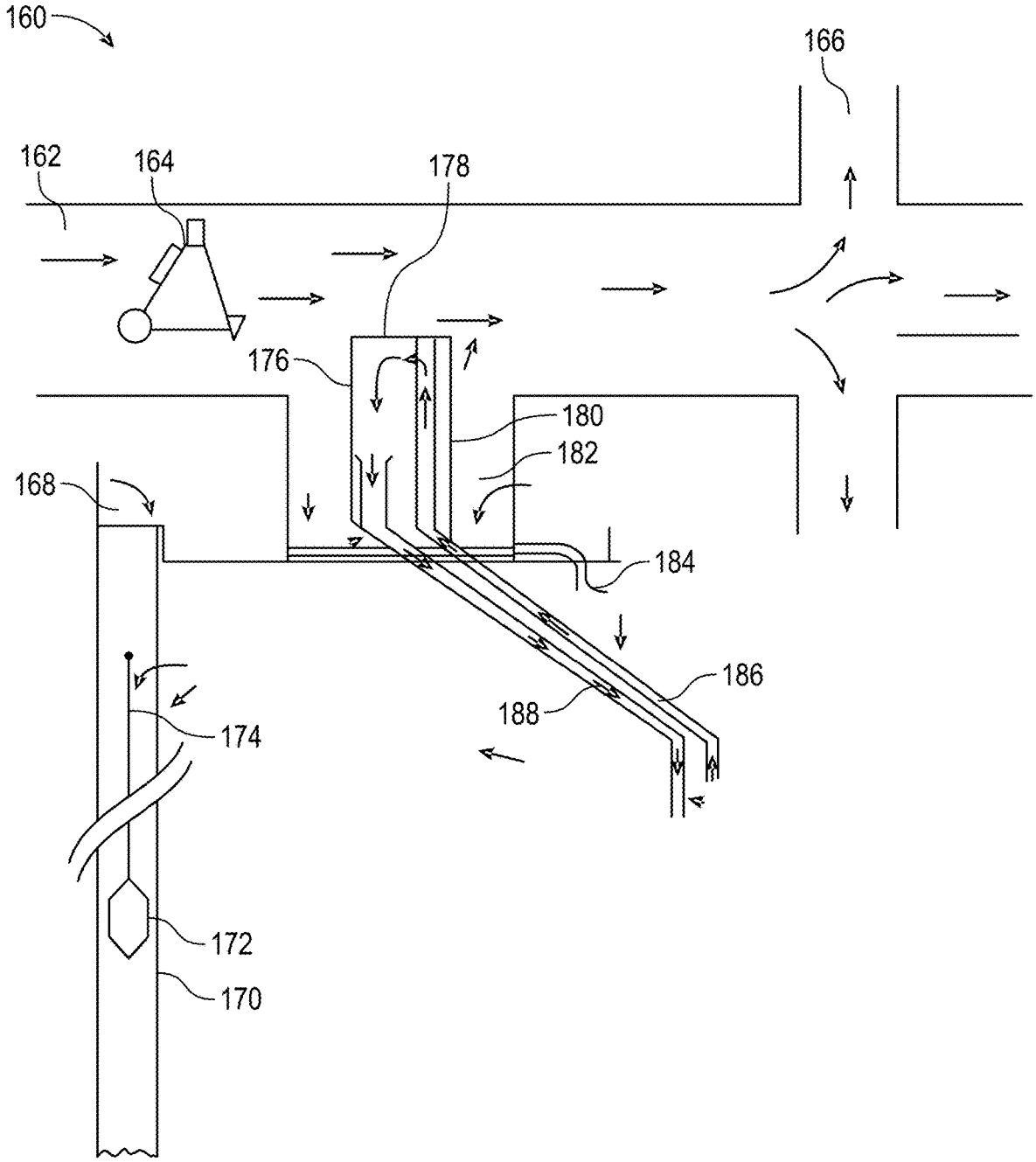
FIG. 16 illustrates an exemplary setup of a water heater.
Figure 17:
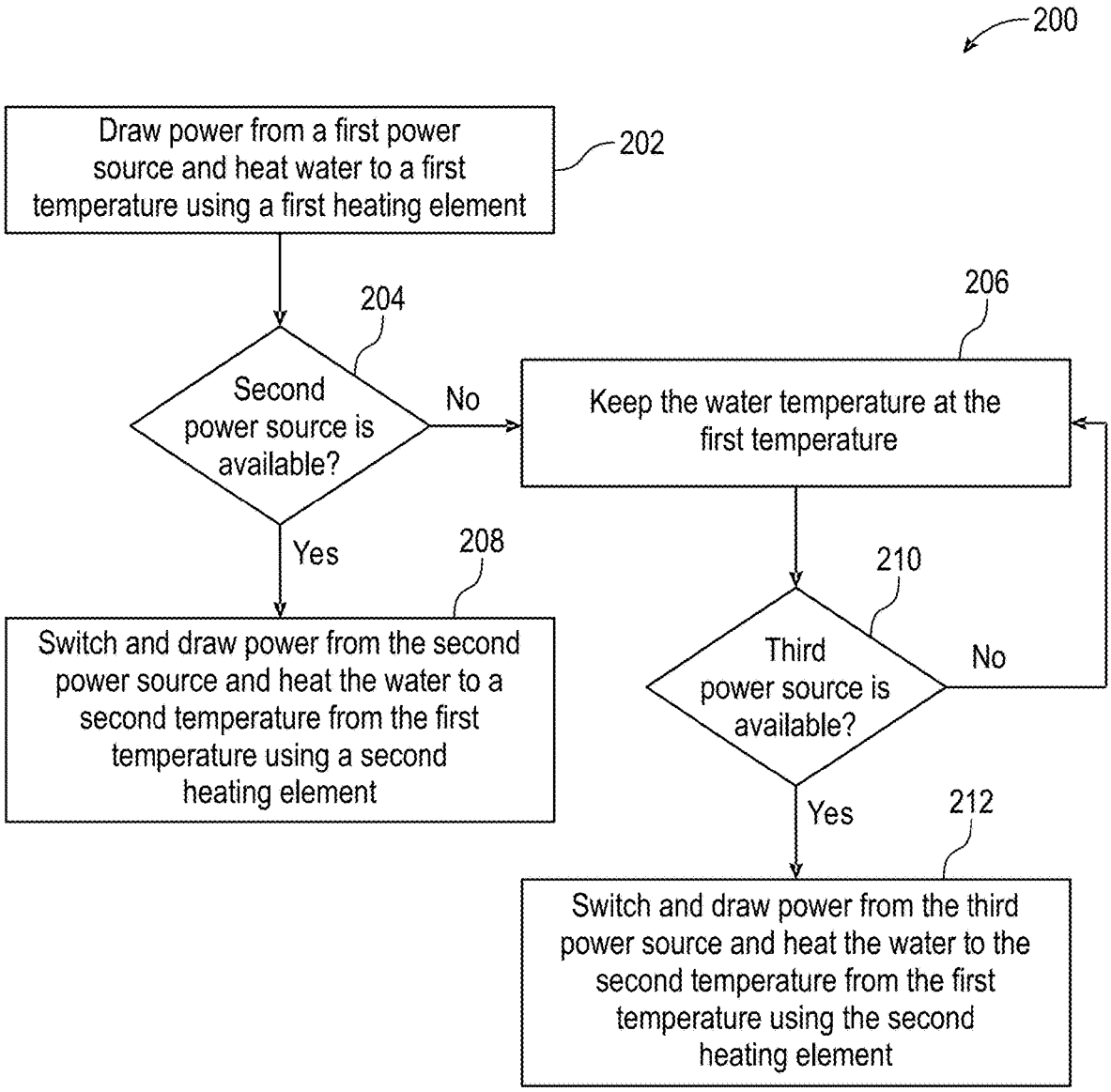
FIG. 17 illustrates a method of heating water, in accordance with another embodiment of the present invention.

Still referring to FIG. 11, housing 110 encompasses a container 112. In one implementation, all sides of container 112 are provided with silvishade cloth reflective material. The silvishade reflects sunlight, creating shade on the air conditioning unit, such that the air will be cooler on the inside than outside. In winter conditions, it is possible to add between the air conditioning unit and the shade cloth a heat blanket to aid the heat pump operations, similar to electric blanket. Container 112 presents a wall 114, say house brick wall on one side, concrete slab at the bottom and receives cooler sir 116 from the opposite side of wall 114. The area denoted by X inside container 112 indicates an area on the outer air conditioning unit cover where outside air is condensed and blown out through top by a fan (forced air). FIG. 12 shows an air conditioning unit 120 (similar to air conditioning unit 118), in accordance with one embodiment of the present invention. air conditioning unit 120 includes a housing unit 122 having posts 124 at all corners for affixing to the wall. In one example, three sides 126, 128 of air conditioning unit 120, say about 80% of the air conditioning unit 120 is provided with shade material (silvishade cloth reflective material) at an angle of 45 degrees. Air conditioning unit 120 includes a fan housing 130 having blades 132. FIG. 12 is shown to illustrate that shade cloth 126, 128 is provided at the bottom and sides of air conditioning unit 120 such that air temperature being circulated through the condenser coil is at least 10 degrees below the ambient temperature and would make the condenser more efficient and reduce the energy cost. FIG. 13 shows a feature of shade cloth 126 on all sides. Here, shade cloth 126 does not cover fan housing 130. FIG. 14 shows a bottom portion of air conditioning unit 118 shown above in FIG. 11. Here, area 135 indicates an area of flow created when fan 130 is ON. Two valves 138 are provided to check coils 137 housed in a container 136. Coils 137 are insulated and used as a form of heating freon for winter operations and supply heat to hot water heater which maintains a constant temperature to heat exchanger. This would be used to improve efficient use of heat pump when operating below its optimum for heating reuse.

FIG. 18 shows water heater 160, in accordance with one exemplary setup. The exemplary setup presents a PVC pipe system used to run a line from the external HWH line to the air conditioning duct work where, past the coil. A heat exchanger is placed inside of existing duct work with a return line to the hot water heater. This feature would only be active in cold weather and controlled by a controller (not shown) integrating an artificial intelligence (AI) program. The process ceases when the thermostat setting was reached. The AI program determines the proper time to start or stop hot water flow. Here, water is used as fluid to provide a safety system and a drain line would catch water leaking from water lines and heat exchanger. The A/C filter positioned ahead of the heat exchanger is used to capture and clean air to heat exchanger or a separate exchange filter is used. The additional adoption would be with AC Freon and no water. The same approach would be taken with the Freon as the water. Two Freon lines would be run (one intake, one outtake) one insulated and one not. The process would be the same as water, except the Freon method is used to enhance the ability to heat and cool during weather extremes. The Freon exchanger is attached to the AC unit by way of testing ports normally provided to service the AC unit. The ability to test the heat exchanger and main AC requires an additional set of testing ports at the end of the heat exchanger for service. The heat exchanger function is controlled inside by the thermostat/controller using AI program. The heat exchanger is finned on the outside to improve efficiency for both heating and cooling. The heat exchanger is shut off when not needed for efficiency. Water heater 160 includes a primary duct 162, and an electric bar 164. Primary duct 162 receives air, which passes through electric bar 164. The air flow is directed to AC through a RM duct 166. In some implementations, the airflow 168 is directed to HWH pipe 170 having a heating member 172 connecting a powerline 174. Water heater 160 includes a heat exchanger 176 with fins 178. Heat exchanger 176 connects to outlet 180 having a drip pan 182 for the air-conditioning unit. Outlet 180 connects to an outside pipe 184. Further, outlet 180 connects to a hot water tank pipe 186. Cold water is supplied to water heater 160 via an inlet line 188. Here, exchanger 176 has a hotter flow to upper heat exchange with a lower cool water return to hot water.

In accordance with the present invention, first power source 19 is used to heat the water up to 40° F. If the water heater is set for 125° F., then the difference between 40° F. and 125° F., i.e., 85° F. is achieved using second power source 33 i.e., using solar energy. Optionally, when the second power source 33, say solar energy is not available at night time, then an alternate source say, batteries 80 are used to achieve the temperature of 125° F., from the water temperature of 40° F. This way, water heater 10 helps to reach the required temperature of 125° F. much faster.

Further, water heater 10 includes a pop off pressure relief valve 45. Pop off pressure relief valve 45 connects to a third heating element 50 via a third pipe or outlet line 52. Third pipe 52 is insulated from top to bottom of water heater 10 to reduce heat loss. The length of third pipe 52 can be adjusted to increase the amount of hot water availability in water heater 10.

Figure 5A:
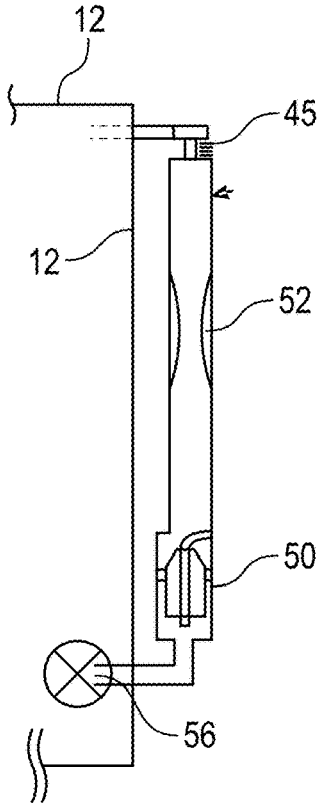
Figure 5B:
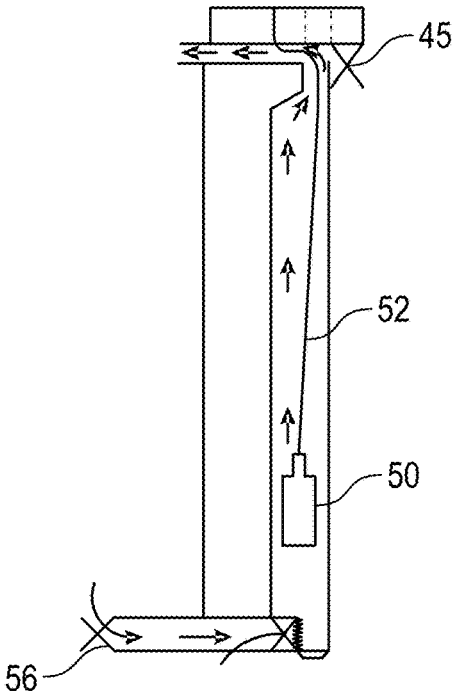

FIG. 5A shows a partial view of pop off pressure relief valve 45 positioned adjacent to water heater 10, in accordance with one embodiment of the present invention. FIG. 5B shows a partial view of pop off pressure relief valve 45 positioned adjacent to water heater 10, in accordance with another embodiment of the present invention. In one example, pop off pressure relief valve 40 has a third armored power wire 54 connecting pop off pressure relief valve 40 and third heating element 50. Pop off pressure relief valve 40 helps to relieve high pressure inside housing 12 for safety. Further, third heating element 50 is connected to a drain valve 56. The flow path with third heating element 50 outside of the hot water tank 12 from drain valve 56 to pop off pressure relief valve 40 is installed with or without third heating element 50 installed. This is done to allow natural flow of hot water to top of hot water heater 10. Here, installation of third heating element 50 at the lower end of the outside third pipe 52 presents an advantage should other heating features fail. It should be noted that third heating element 50 is placed high enough in third pipe 52 to allow for draining of any sediment that might accumulate through drain valve 56. In some instances, third heating element 50 may take extra room below where it is set to catch sediment for removal via drain valve 56. In one example, water heater 10 includes a faucet 28 to discharge water from water heater 10.

Figure 6:
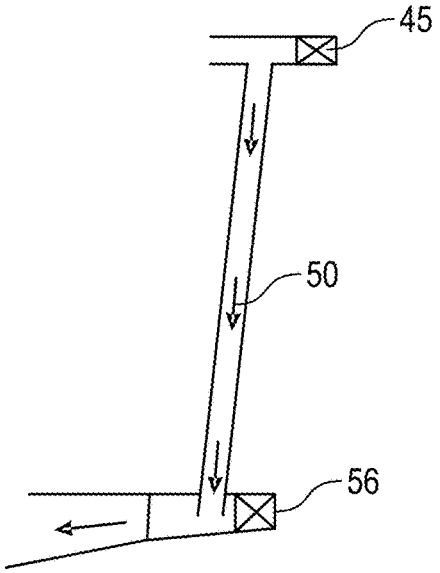
FIG. 6 illustrates a pop off pressure relief valve, in accordance with one exemplary embodiment of the present invention.
Figure 7:
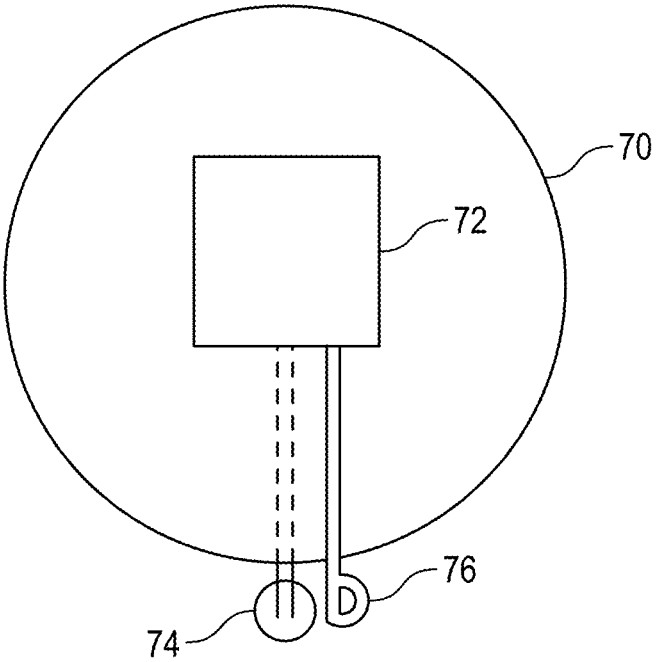
FIG. 7 illustrates a heat pump, in accordance with one embodiment of the present invention.

FIG. 6 shows an alternate embodiment of pop off pressure relief valve 45. Here, a T-shaped connection tube is in pop off pressure relief valve 45 in order to use drain valve 56 temporarily. In accordance with one embodiment of the invention, FIG. 7 shows an above view of heat pump 72, a discharge line 76, and a return line 74 both with check valves to allow connections for auxiliary functions outside the AC unit to be installed. Here, heat pump 72 connects to a first valve 74 and a second valve 74. Each of first valve 74 and second valve 74 includes check valves. A separate unit that is pressure tight such as A/C service unit is used to operate and match with the operating pressure of the A/C using a service unit. In one example, heat pump 72 with a separate chamber for refrigerant heating through heating element using solar energy to bring temperature back to efficient mode for heat pump 72. In one example, a control box (not shown) is used to regulate the source of power i.e., A/C solar or batteries. This is to help in the case of loss of A/C from the grid.

Here, the temperature of first heating element 18 is set to 40 or 50 degrees Fahrenheit (50° F.) or as may be needed. Setting a low temperature of 40° or 50° F. helps to save energy cost for both users and power utility providers. In case of a power failure, alternate power will activate and maintain the power of first heating element 18.

As can be seen from FIG. 1, the flow path of inlet source water is through the top of the water inlet connection and downward around first power wire 20 to first heating element 18 is used to heat the water in tank/housing 12. Inlet pipe 14 has two connections that are on top of each other and located outside the top of water heater 10. The bottom connections allows the source water to enter inlet pipe 14. A second connection above the water inlet connects first power wire 20 (armored power wire) that runs through both connections. First power wire 20 is connected to first heating element 18 (cal-rod) located near the bottom of inlet pipe 14. There is a flow path just about four inches below the top of inlet pipe 14 (about 2 3/16" holes) that allows hot water from lower first heating element 18 to create flow between the top and bottom circulation ports on inlet pipe 14 by migration of water or applied heat. The flow path of inlet source water is through the top of the water inlet connection and downward around the cable to first heating element 18 used to heat the water in tank/housing 12. In one implementation, first heating element 18 has a flow path created by holes or slots 24 for heating the water around the middle of first heating element 18. The open end of inlet pipe 14 allows water flow and any sediment to exit inlet pipe 14. Further, sediment falls to the bottom of tank/housing 12. In addition, first heating element 18 can be latched to the bottom of inlet pipe 14 to prevent fluid from moving first heating element 18 up or down inside inlet pipe 14. It should be understood that it may not be possible to attach first heating element 18 to inlet pipe 14 as all water forces under normal operations would be downward to keep first heating element 18 in place. As first heating element 18 in inlet pipe 14 is supplied with AC power supplied by the utility company, down first power wire 20 to first heating element 18 with alternative power, if needed. The Temperature setting of 125 degrees F. or as needed is maintained throughout water heater 10 by heating element 18, 32, 50. The lower temperature which is less than the final temperature results in savings of energy cost for the consumer and the utility company. In some implementations, a gas fired burner (not shown) and controls can be used in place of first heating element 18 as a heat source in inlet pipe 14.

A small amount of cool water enters hot water when hot water is flowing out of the tank. When water reaches a pre-set temperature say 50° F., first heating element 18 shuts down and other flow paths with second heating element 32 and/or third heating element 50 increase and maintain constant temperature to maximum. Once hot water begins to flow from the tank, first heating element 18 turns ON to quickly maintain heat at maximum temperature.

FIG. 1 shows three different openings, a first opening 60, a second opening 62, and a third opening 64 in inlet pipe 14 to allow flow from inlet pipe 14 to the water between the water tank inside the wall and the outside of the inlet pipe 14. First opening 60 has two 3/16" holes to allow some inlet water out of inlet pipe 14. Second opening 62 is a larger opening close to the bottom of the water tank and is positioned about even with the halfway mark of second heating element 32. This allows easy flow out to the total volume of the water tank. The last flow path via third opening 64 is the end of inlet pipe 14 and allows water to flow toward or away from first heating element 18 to enhance heat exchange. In the present invention, the flow paths FP2, and FP3 allow water or heated water to migrate to the top of the tank to maximum temperature.

In one embodiment, first heating element 18 is set with a temperature of 50° F. plus 75-85° F. for a total of 125° F. from an alternate source, say renewable energy (solar energy). Here, second heating element 32 is adjusted to a total of 90° F. which would be the maximum tank pressure for second heating element 32 to achieve. A person skilled in the art understands that when water temperature reaches 125° F., third heating element 50 located in the outside flow path increases water temperature to the final temperature of 120-130° F., if needed. The maximum temperature is maintained for a longer period of time by water flowing from the bottom of third pipe 52 to the top of the hot water heater 10.

A person skilled in the art understands that it is possible to heat water by running converted solar/battery energy to AC and replacing AC from the utility company to AC from an alternate energy source. This would allow all controls of the heating elements to operate as if connected to the utility company. The connection to the utility company would not be operational nor involve only alternate energy resulting in energy savings and money spent. It would be possible to eliminate any utility company electricity to be used.

FIG. 18 shows a method 200 of heating water, in accordance with one embodiment of the present invention. The order in which method 200 is described should not be construed as a limitation, and any number of the described method blocks can be combined in any order to implement method 200 or alternate methods. Additionally, individual blocks may be deleted from method 200 without departing from the spirit and scope of the invention described herein. Furthermore, method 200 can be implemented in any suitable hardware, software, firmware, or combination thereof. However, for ease of explanation, in the embodiments described below, method 200 might be implemented using the above-described water heater 12.

Method 200 begins at step 202. At step 202, water is received via an inlet pipe 14. The water is heated and the temperature of water is maintained at a first temperature say at 40° F. by drawing energy from a first power source, say via grid (supplied by a utility company). Alternatively, water is heated and the temperature of water is maintained at a first temperature say at 100° F. by drawing energy from a first power source, say via grid (supplied by the utility company). At step 204, water heater 10 checks if second power source 32, say solar energy is available to heat water from the first temperature i.e., from 40° F. to 125° F. using a second heating element 32. Alternatively, water heater 10 checks if second power source 32, say solar energy is available to heat water from the first temperature i.e., from 100° F. to 140° F. using a second heating element 32. If second power source 32 is available, then method 200 moves to step 208. At step 208, water heater 12 employs second heating element 32 to heat the water from 40° F. to 125° F. using solar energy.

If the solar energy is not available or the energy from the solar energy is insufficient, then water heater 12 continues to employ first heating element 18 to draw power from first power source 19 and maintain the temperature at the first temperature, as shown at step 204. Further, water heater 12 checks additional power source i.e., a third power source is available to heat the water from 40° F. to 125° F., as shown at step 210 in the absence of the second power source. If the third power source is not available, then water heater 12 continues to employ first heating element 18 to draw power from first power source 19 and maintain the temperature at the first temperature, as shown at step 204. If the third power source is available, say in the form of batteries or a wind turbine, the water heater 10 employs second heating element 32 to heat the water from 40° F. to 125° F. using the batteries or wind turbine, as shown at step 212.

The presently disclosed water heater provides several advantages over the prior art. The heating elements can be removed for repair or replacement by disconnecting power and water pass through fittings and this will allow the heating elements to be pulled out using the armored electric wire. This ensures the inlet or outlet or both to be fully open for inspection by small camera or gauge ring. The second heating element allows water inside the outlet pipe to be at operating temperature quickly due to water volume inside hot water heater since the outlet valve is small and easy to bring to operating temperature by second heating element from 40° F. and 125° F. The third heating element installed near the bottom of the outside outlet/inlet pipe allows the hot water to flow/migrate upward to aid in maintaining temperature at top of the hot water tank outlets.

A person skilled in the art appreciates that the water heater can come in a variety of shapes and sizes depending on the need and comfort of the user. Further, many changes in the design and placement of components may take place without deviating from the scope of the presently disclosed water heater.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

I claim:

1. A water heater, comprising:

a housing, comprising:

an inlet pipe positioned within said housing for receiving water;

a first heating element positioned in said inlet pipe, wherein said first heating element heats the water to a first temperature, and wherein said first heating element is powered by a first power source;

an outlet pipe positioned within said housing and operatively connecting said inlet pipe, wherein said outlet pipe discharges the water; and a second heating element positioned within said outlet pipe, wherein said second heating element further heats the water from said first temperature to a second temperature, wherein said second heating element is powered by a second power source, and wherein said second power source is different from said first power source;

an outlet line positioned outside of said housing;

a third heating element positioned within said outlet line, wherein said third heating element positions between a pressure relief valve and a drain valve, and wherein said third heating element installs at the bottom of the outside of said inlet pipe and said outlet pipe; and a controller operatively connecting said first heating element said second heating element, and said third heating element, wherein said controller determines the energy needed from said second power source to maintain heat of the water at said second temperature, and wherein said third heating element allows the hot water to flow upward to maintain the temperature of the water at said second temperature.

2. The water heater of claim 1, wherein said first heating element heats the water to said first temperature of 40 to 100 degrees Fahrenheit.

3. The water heater of claim 1, wherein said second heating element heats the water to said second temperature of 125 to 140 degrees Fahrenheit.

4. The water heater of claim 1, wherein said first power source comprises an alternating current (AC) power source or direct current (DC) power source.

5. The water heater of claim 1, wherein said second power source comprises a renewable energy source.

6. The water heater of claim 1, wherein the third pipe is insulated to reduce heat loss.

7. The water heater of claim 1, wherein said first heating element has a first flow path created by first slots at said inlet pipe for heating the water around said first heating element.

8. The water heater of claim 1, wherein said second heating element has a second flow path created by second slots at said outlet pipe for heating the water around said second heating element.

9. The water heater of claim 1, wherein said first heating element is powered by said first power source via a first power wire.

10. The water heater of claim 1, wherein said second heating element is powered by said second power source via a second power wire.

11. The water heater of claim 1, further comprises a heat exchanger having a return line connected to said housing via a duct for recovery of the heat from the discharged water.

12. The water heater of claim 1, further comprises a third power source, wherein said third power source powers said second heating element when the second power source is unavailable.

13. The water heater of claim 12, wherein said third power source comprises batteries.

14. A water heater, comprising:

a housing, comprising:

an inlet pipe positioned within said housing for receiving water;

a first heating element positioned in said inlet pipe, wherein said first heating element heats the water to a first temperature, and wherein said first heating element is powered by a first power source;

an outlet pipe positioned within said housing and operatively connecting said inlet pipe, wherein said outlet pipe discharges the water; and a second heating element positioned within said outlet pipe, wherein said second heating element further heats the water from said first temperature to a second temperature, wherein said second heating element is powered by a second power source or a third power source, wherein each of said second power source and said third power source is different from said first power source, and wherein said third power source powers said second heating element when the second power source is unavailable;

an outlet line positioned outside of said housing;

a third heating element positioned within said outlet line, wherein said third heating element positions between a pressure relief valve and a drain valve, and wherein said third heating element installs at the bottom of the outside of said inlet pipe and said outlet pipe; and a controller operatively connecting said first heating element said second heating element, and said third heating element, wherein said controller determines the energy needed from said second power source or said third power source to maintain heat of the water at said second temperature, and wherein said third heating element allows the hot water to flow upward to maintain the temperature of the water at said second temperature.

15. The water heater of claim 14, wherein said first heating element heats the water to said first temperature of 40 to 100 degrees Fahrenheit, and wherein said second heating element heats the water to said second temperature of 125 to 140 degrees Fahrenheit.

16. The water heater of claim 14, wherein said first power source comprises an alternating current (AC) power source or direct current (DC) power source, wherein said second power source comprises a renewable energy source, and wherein said third power source comprises batteries.

17. A method of heating water in a water heater, said method comprising the steps of:

providing a housing having an inlet pipe, said inlet pipe configured for receiving water;

providing a first heating element positioned in said inlet pipe, said first heating element heating the water to a first temperature, said first heating element being powered by a first power source;

providing an outlet pipe positioned within said housing and operatively connecting said inlet pipe, said outlet pipe configured for discharging the water;

providing a second heating element positioned within said outlet pipe, said second heating element configured for further heating the water from said first temperature to a second temperature, said second heating element being powered by a second power source, said second power source being different from said first power source;

providing an outlet line positioned outside of said housing;

providing a third heating element positioned within said outlet line, said third heating element positioned between a pressure relief valve and a drain valve, said third heating element installed at the bottom of the outside of said inlet pipe and said outlet pipe; and operating said first heating element said second heating element and said third heating element such that the energy needed from said second power source is maintained to heat the water at said second temperature, said third heating element allowing the hot water to flow upward to maintain the temperature of the water at said second temperature.

18. The method of claim 17, further comprising heating the water between 40 to 100 degrees Fahrenheit using said first heating element, and heating the water between 125 to 140 degrees Fahrenheit using said second heating element.

* * * * *